US009894937B2

(12) United States Patent
Li et al.

(10) Patent No.: US 9,894,937 B2
(45) **Date of Patent: *Feb. 20, 2018**

(54) ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 21 days.

This patent is subject to a terminal disclaimer.

(21) Appl. No.: 15/147,912

(22) Filed: May 6, 2016

(65) Prior Publication Data

US 2016/0249683 A1 Sep. 1, 2016

(30) Foreign Application Priority Data

Jul. 31, 2015 (CN) ..... 2015 2 0567544 U

(51) Int. Cl.

| | |
|---|---|
| ***A24F 47/00*** | (2006.01) |
| ***H05B 3/00*** | (2006.01) |
| ***H05B 3/14*** | (2006.01) |

(52) U.S. Cl.

CPC ..... *A24F 47/008* (2013.01); *H05B 3/0014* (2013.01); *H05B 3/14* (2013.01)

(58) Field of Classification Search

CPC ..... A24F 47/008; A24F 47/002; A24F 47/00; H05B 3/0014; H05B 3/14; B65D 85/70

See application file for complete search history.

(56) References Cited

U.S. PATENT DOCUMENTS

| | | | | |
|---|---|---|---|---|
| 2015/0342255 | A1* | 12/2015 | Wu | A61M 15/06 131/329 |
| 2015/0342257 | A1* | 12/2015 | Chen | H05B 3/06 392/390 |
| 2016/0135504 | A1* | 5/2016 | Li | A24F 47/008 392/395 |
| 2016/0219934 | A1* | 8/2016 | Li | A24F 47/008 |
| 2016/0219935 | A1* | 8/2016 | Qiu | A24F 47/008 |
| 2016/0227841 | A1* | 8/2016 | Li | A61M 15/06 |

(Continued)

*Primary Examiner* — Gary Paumen

(74) *Attorney, Agent, or Firm* — Cheng-Ju Chiang

(57) ABSTRACT

An exemplary atomizer includes a liquid supply and an atomizing assembly connected with the liquid supply. The liquid supply has a liquid chamber. The liquid supply includes a sealing piece at an end, and the sealing piece defines a liquid outlet. The atomizing assembly includes a connecting part. The liquid supply includes an engaging part. The engaging part includes a rotary sealing element rotatable relative to the sealing element. When the liquid supply and the atomizing assembly are disassembled, the rotary sealing element seals the liquid outlet. When the connecting part is inserted into the engaging part and rotated a first angle, the atomizing assembly and the liquid supply are engaged. When the atomizing assembly is further rotated a second angle, the atomizing assembly drives the rotary sealing element to rotate to open the liquid outlet, and the tobacco liquid in the liquid chamber flows into the atomizing assembly.

10 Claims, 5 Drawing Sheets

(56) References Cited

U.S. PATENT DOCUMENTS

| | | | | |
|---|---|---|---|---|
| 2016/0249683 | A1* | 9/2016 | Li | A24F 47/008 |
| 2016/0302487 | A1* | 10/2016 | Chen | A24F 47/00 |
| 2017/0156408 | A1* | 6/2017 | Li | A24F 47/008 |
| 2017/0181476 | A1* | 6/2017 | Li | A24F 47/008 |
| 2017/0202268 | A1* | 7/2017 | Li | A24F 47/008 |

* cited by examiner

ATOMIZER AND ELECTRONIC CIGARETTE HAVING SAME

TECHNICAL FIELD

The present invention relates to electronic cigarettes, and particularly to an atomizer and an electronic cigarette using same.

BACKGROUND ART

A typical atomizer includes a liquid supply and an atomizing assembly. The liquid supply is configured for storing tobacco liquid, and the tobacco liquid is usually sealed by aluminum foil. The atomizing assembly includes a pricking component. When the liquid supply is coupled to the atomizing assembly, the pricking component pierces the aluminum foil, so that the tobacco liquid flows into the atomizing assembly. However, when replacing the liquid supply with a new one, the tobacco liquid remained in the liquid supply may flow out and pollute the atomizing assembly. Accordingly, user experience of the atomizer is unsatisfactory.

What are needed, therefore, are an atomizer and an electronic cigarette using same, which can overcome the above shortcomings.

SUMMARY

An exemplary atomizer includes a liquid supply and an atomizing assembly detachably connected with the liquid supply. The liquid supply has a liquid chamber configured for storing tobacco liquid. The liquid supply includes a sealing piece at an end, and the sealing piece defines a liquid outlet. The atomizing assembly includes a connecting part. The liquid supply includes an engaging part matching with the connecting part. The engaging part includes a rotary sealing element rotatable relative to the sealing element. When the liquid supply and the atomizing assembly are disassembled, the rotary sealing element seals the liquid outlet. When the connecting part is inserted into the engaging part and rotated a first angle, the atomizing assembly and the liquid supply are engaged to form a snap fit connection. When the atomizing assembly is further rotated a second angle relative to the liquid supply, the atomizing assembly drives the rotary sealing element to rotate to open the liquid outlet, the tobacco liquid in the liquid chamber flows into the atomizing assembly via the liquid outlet.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
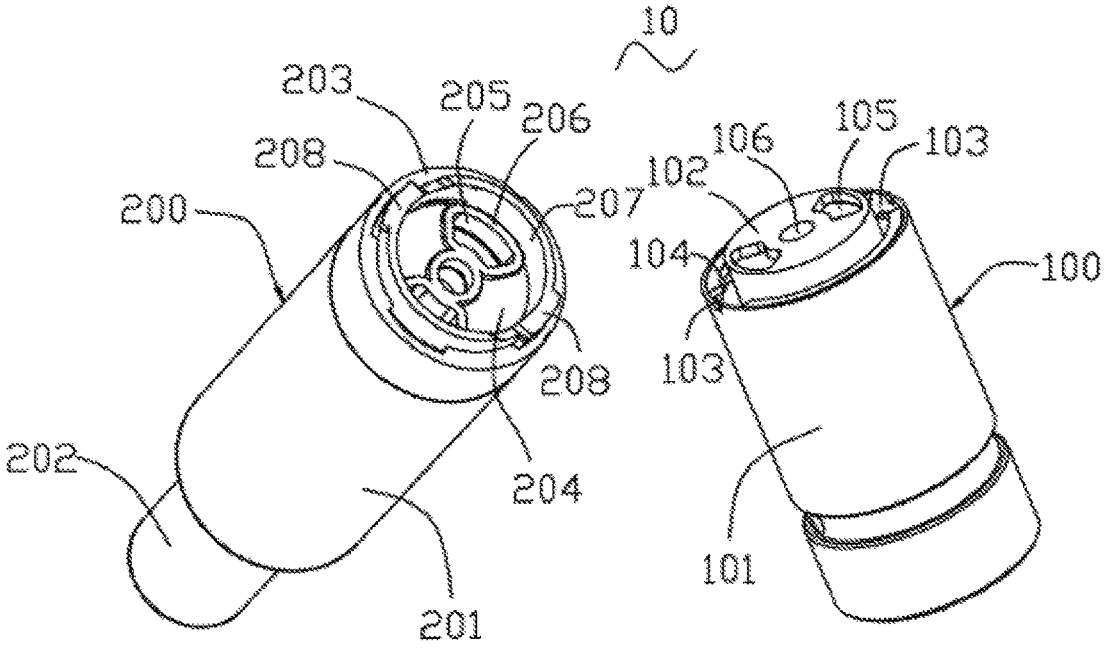
FIG. 1 is a perspective view of an atomizer according to a first embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
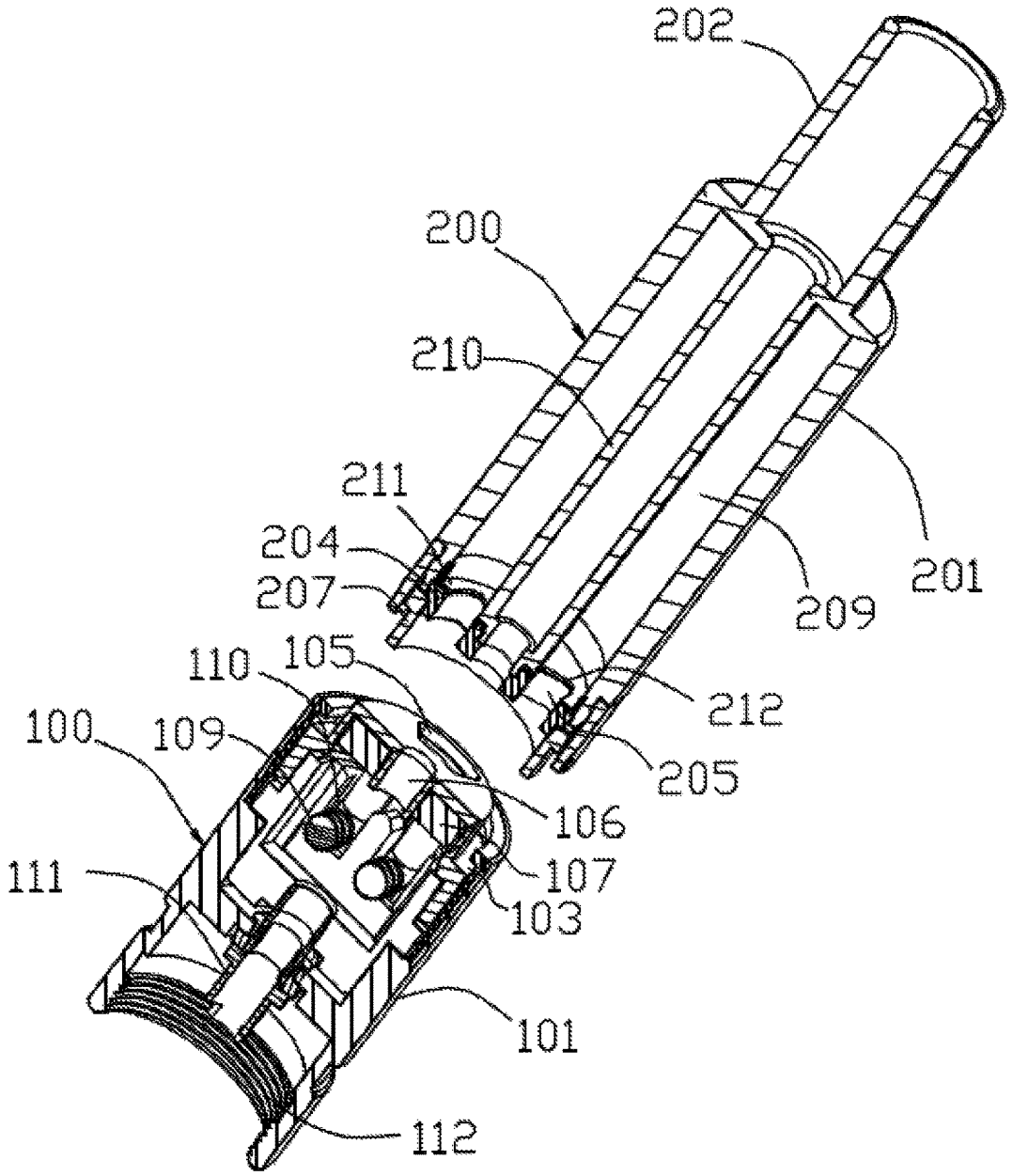
FIG. 2 is a cross-sectional view of the atomizer of FIG. 1.

Referring to FIGS. 1-2, an atomizer 10 includes a liquid supply 200 and an atomizing assembly 100 detachably connected with the liquid supply 200. The liquid supply 200 includes a housing 201 extending axially, and the housing 201 defines a liquid chamber 209 for storing tobacco liquid. An end of the liquid supply 200 is provided with a sealing piece 211 with liquid outlets 212, the other end of the liquid supply is provided with a mouthpiece 202. The atomizing assembly 100 includes a connecting part 102, and the liquid supply 200 includes an engaging part 203 configured (i.e., structured and arranged) for coupling with the connecting part 102. The engaging part 203 includes a rotary sealing element 204. The rotary sealing element 204 is rotatable relative to the sealing piece 211. When the liquid supply 200 is not connected with the atomizing assembly 100, the rotary sealing element 204 seals the liquid outlets 212, avoiding liquid leakage. When the connecting part 102 is inserted into the engaging part 203 and is rotated a first angle, the atomizing assembly 100 is engaged with the liquid supply 200 by snap fit. In use, the atomizing assembly 100 is further rotated a second angle, the atomizing assembly 100 drives the rotary sealing element 204 to rotate to a position where the liquid outlets 212 are opened. In this position, the tobacco liquid in the liquid chamber 209 can flow into the atomizing assembly 100 via the liquid outlets 212, and the atomizing assembly 100 can work normally.

In the present embodiment, the first and the second angles are both 90 degrees. When the atomizer 10 is not used, the atomizing assembly 100 is rotated 90 degrees in a reverse direction, the rotary sealing element 204 is rotated back to a position where the liquid outlets 212 are sealed, avoiding liquid leakage. When the atomizing assembly 100 is further rotated 90 degrees in the reverse direction, the rotary sealing element 204 will not be rotated, and the atomizing assembly 100 and the liquid supply 200 can be disengaged from each other.

A tubular element 210 is further provided in the liquid chamber 209. The tubular element 210 is hollow, and allows air to pass through. The sealing piece 211 fixedly sleeves an end of the tubular element 210, and the rotary sealing element 204 rotatably nests the end of the tubular element 210. The other end of the tubular element is connected with the mouthpiece 202. The connecting part 102 defines an aerosol outlet 106 in a central part. When the atomizing assembly 100 is connected with the liquid supply 200, the end of the tubular element 210 abuts against an end surface of the connecting part 102, and the aerosol outlet 106 is in communication with the tubular element 210.

Quite usefully, the rotary sealing element 204 is made of resilient material, for example, silica gel. The rotary sealing element 204 elastically abuts against the sealing piece 211. The rotary sealing element 204 defines liquid holes 205 matching with the liquid outlets 212. During rotation of the rotary sealing element, the liquid holes 205 are in alignment or misalignment with the liquid outlets 212. When the liquid holes 205 are in misalignment with the liquid outlets 212, the liquid outlets 212 are sealed by the rotary sealing element 204. When the liquid holes 205 are in alignment with the liquid outlets 212, the liquid outlets 205 are opened.

Further, the connecting part 102 defines liquid inlets 105. In the present embodiment, the liquid inlets 105 are symmetric about a center of the connecting part 102. When the atomizing assembly 100 is inserted into the liquid supply 200, and rotated a first angle (e.g., 90 degrees), the liquid inlets 105 are in alignment with the liquid holes 205. As seen in FIG. 1, in an original position, a line connecting two liquid inlets 105 is substantially perpendicular to a line connecting two liquid holes 205. Only when the atomizing assembly 100 is inserted into the liquid supply 200 and is rotated 90 degrees, the liquid inlets 105 are in alignment with the liquid holes 205 in a one-to-one relationship. Quite usefully, sealing ribs 206 are provided on a surface of the rotary sealing element 204 facing the atomizing assembly 100, surrounding the liquid holes 205. When the liquid inlets 105 are in alignment with the liquid holes 205, the sealing ribs 206 abuts against an end surface of the connecting part 102, preventing the tobacco liquid from leaking.

Figure 3:
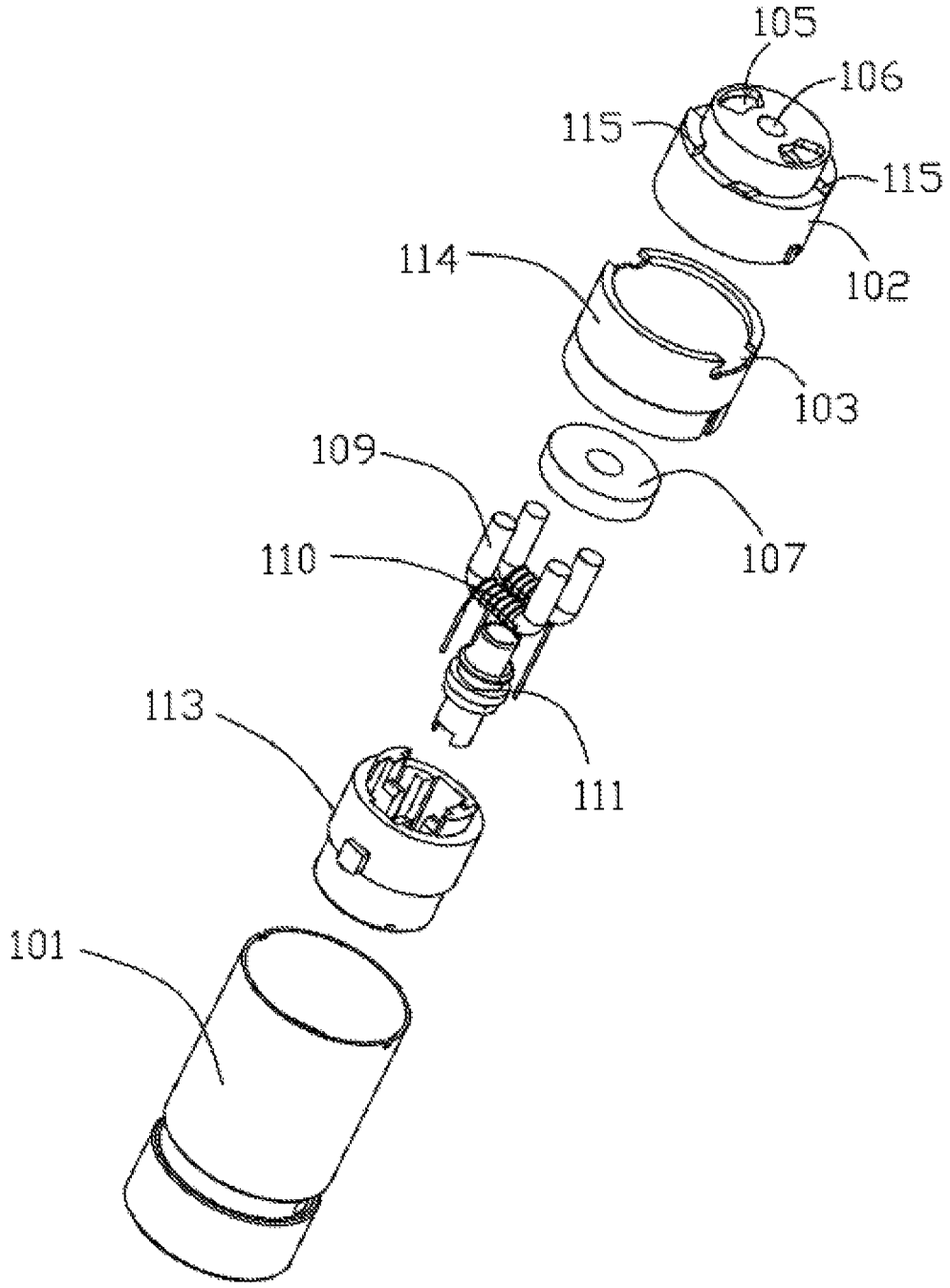
FIG. 3 is an exploded perspective view of an atomizing assembly of the atomizer of FIG. 1.

Referring to FIGS. 2-3, the atomizing assembly 100 includes a shell 101, at least one liquid conducting component 109, and a heating element 110 in contact with the at least one liquid conducting component 109. The liquid conducting component 109 is configured for absorbing tobacco liquid. In the present embodiment, the atomizing assembly 100 includes two liquid conducting components 109. The two liquid conducting components 109 may be made of glass fiber. The heating element 110 may include a heating wire wound around the liquid conducting components 109. Quite usefully, to control a flowing rate of the tobacco liquid into the atomizing assembly 100, an annular buffer layer 107 is sandwiched between the liquid conducting components 109 and the liquid inlets 105. End portions of the liquid conducting components 109 are in contact with the buffer layer 107.

A bracket 113 is further arranged in the shell 101, and configured for supporting the liquid conducting components 109 and the heating element 110. A conductive terminal 111 is further provided in the shell 101. The shell 101 is electrically conductive, and insulated from the conductive terminal 111. Two opposite ends of the heating wire are connected to the shell 101 and the conductive terminal 111. The shell 101 includes a plurality of internal screw threads at a bottom end.

Figure 4:
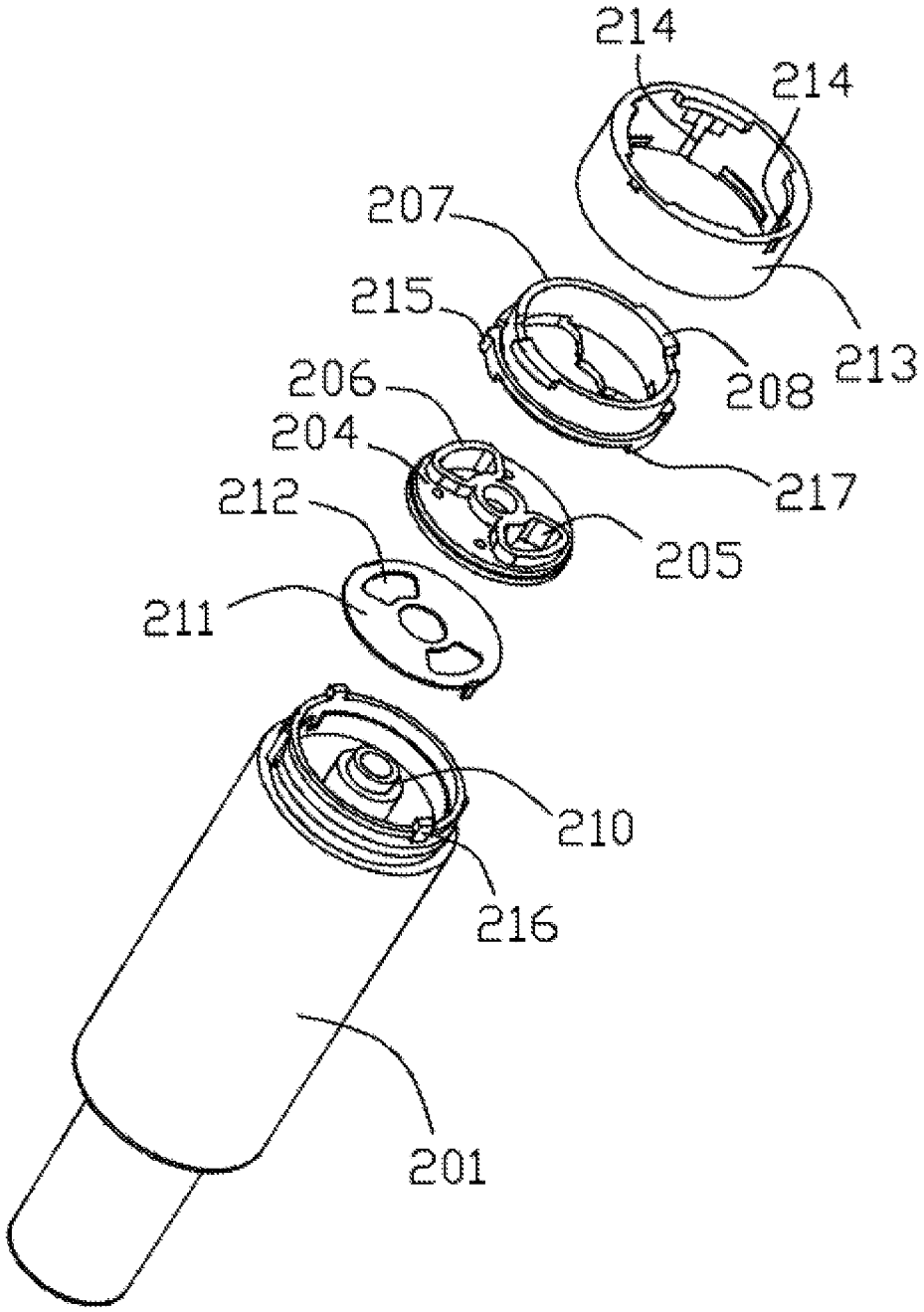
FIG. 4 is an exploded perspective view of a liquid supply of the atomizer of FIG. 1.

Referring to FIGS. 2 and 4, the liquid supply 200 further includes a connecting rotor 207. The connecting rotor 207 is capable of driving the rotary sealing element 204 to rotate. In the present embodiment, the connecting rotor 207 includes two engaging parts 208 symmetric about a center thereof. A line connecting the two engaging parts 208 is substantially perpendicular to a line connecting the two liquid holes 205. The connecting part 102 includes two inserting openings 103 and an arc-shaped groove 104 (as seen in FIGS. 1-2). The two inserting openings 103 are oriented along a line passing the two liquid inlets 105. The arc-shaped groove 104 is configured for coupling with the engaging parts 208 by snap fit. When the atomizing assembly 100 is engaged with the liquid supply 200, the engaging parts 208 are inserted into the inserting openings 103 and rotated a first angle (e.g., 90 degrees), and the engaging parts 208 are engaged in the arc-shaped groove 104 to form a snap fit connection.

The liquid supply 200 includes a fixing ring 213 at an end of the housing 201. The connecting rotor 207 and the rotary sealing element 204 are received in the fixing ring 213. The connecting rotor 207 includes a protrusion 215 on a sidewall. Correspondingly, the fixing ring 213 defines at least two notches 214 for coupling with the protrusion 215 on an internal wall. As seen in FIG. 4, an arc angle between two adjacent notches 214 is 90 degrees. That is, the protrusion 215 is engaged in one of the at least two notches 214 after the connecting rotor 207 is rotated a second angle. The housing 201 further includes a stop part 216, the connecting rotor 207 further includes a blocking part 217, and an arc angle between two adjacent blocking parts 217 is 90 degrees. The stop part 216 is rotatable between two adjacent blocking parts 217. In other words, the connecting rotor 207 is rotatable in a range of 90 degrees.

Referring to FIG. 3 again, the atomizing assembly 100 further includes a connecting ring 114, and the two inserting openings 103 are defined in the connecting ring 114. The arc-shaped groove 104 is cooperatively formed by the connecting ring 114 and the connecting part 102. The connecting part 102 includes a plurality of stop parts 115, and an arc angle between two adjacent stop parts 115 is 90 degrees. When the engaging parts 208 are engaged in the arc-shaped grooves 104, the engaging parts 208 are rotatable between two adjacent stop parts 115, that is, in a range of 90 degrees.

When the atomizing assembly 100 is coupled to the liquid supply 200, the engaging parts 208 are inserted into the arc-shaped groove 104. Due to the resilience of the rotary sealing element 204, a force of friction exists between the rotary sealing element 204 and the tubular element 210, and the rotary sealing element 204 will not rotate when the engaging parts 208 rotate in a range of 90 degrees (i.e., the first angle) defined between adjacent stop parts 115. When the atomizing assembly 100 is further rotated in an identical direction, because of the stop parts 115, the connecting rotor 207 and the atomizing assembly 100 will not rotate relative to each other, and the atomizing assembly 100 drives the connecting rotor 207 to rotate the second angle together with the rotary sealing element 204, until the liquid outlets 212 in the sealing piece are opened.

Figure 5:
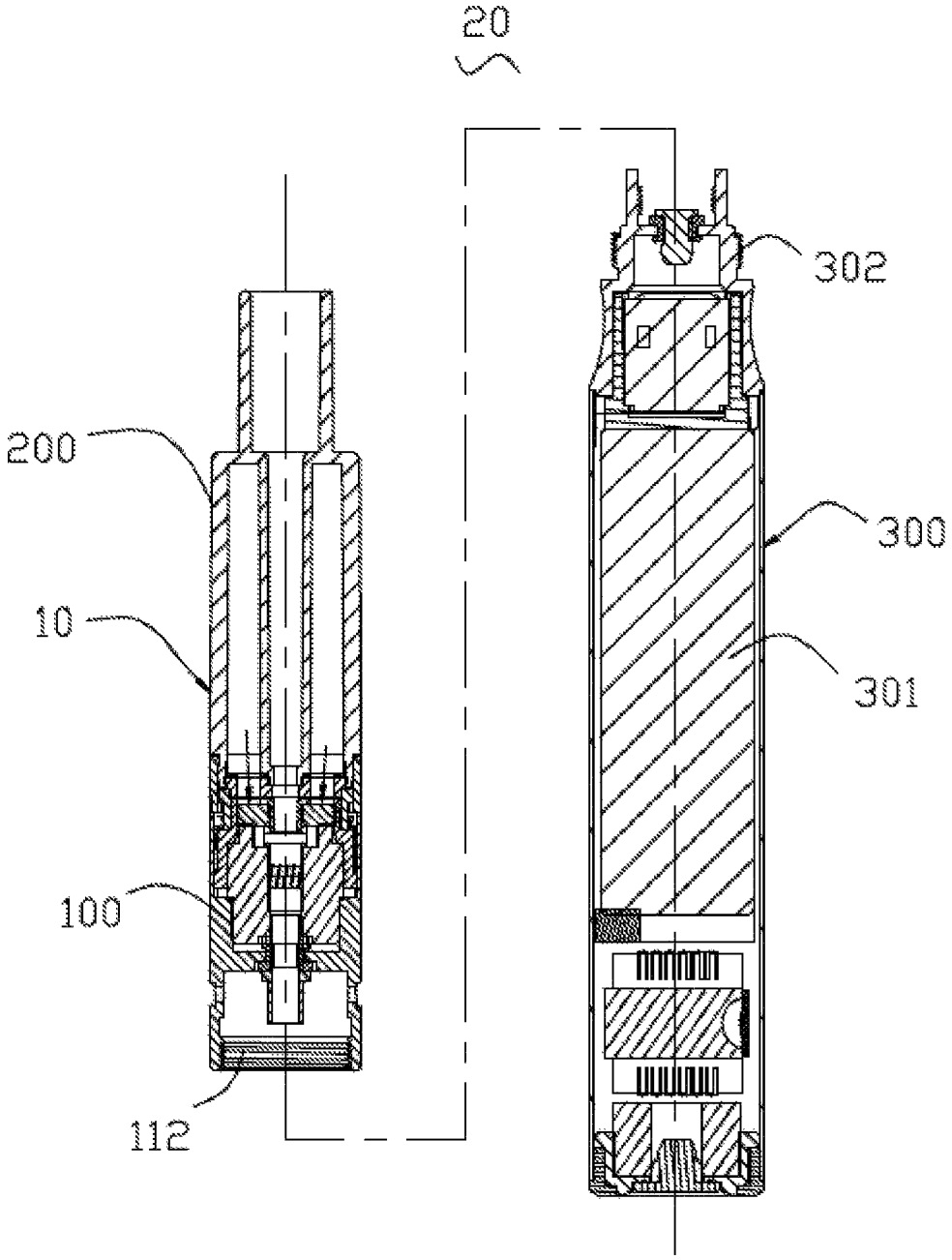
FIG. 5 is a perspective view of an electronic cigarette according to a second embodiment.

Referring to FIG. 5, an electronic cigarette 20 includes an atomizer 10 and a power supply 300 for supplying the atomizer 10 power. The power supply 300 includes a battery 301. The power supply 300 includes a plurality of external screw threads 302 at one end. The external screw threads 302 are configured for coupling with the internal screw threads 112. One end of the atomizing assembly 100 is connected with the liquid supply 200, and the other end is connected with the power supply 300.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer comprising:

a liquid supply and an atomizing assembly detachably connected with the liquid supply, the liquid supply having a liquid chamber configured for storing tobacco liquid, the liquid supply comprising a sealing piece at an end, the sealing piece defining a liquid outlet;

wherein the atomizing assembly comprises a connecting part, the liquid supply comprises an engaging part matching with the connecting part, the engaging part comprises a rotary sealing element rotatable relative to the sealing element, when the liquid supply and the atomizing assembly are disassembled, the rotary sealing element seals the liquid outlet; when the connecting part is inserted into the engaging part and rotated a first angle, the atomizing assembly and the liquid supply are engaged to form a snap fit connection; when the atomizing assembly is further rotated a second angle relative to the liquid supply, the atomizing assembly drives the rotary sealing element to rotate to open the liquid outlet, so that the tobacco liquid in the liquid chamber flows into the atomizing assembly via the liquid outlet.

2. The atomizer according to claim 1, wherein the rotary sealing element is made of resilient material, and abuts against the sealing piece, the rotary sealing element defines a liquid hole, and the liquid hole is selectively in alignment with the liquid outlet during rotation of the rotary sealing element.

3. The atomizer according to claim 2, wherein the connecting part defines a liquid inlet, when the atomizing assembly is inserted into the liquid supply, and rotated a first angle, the liquid inlet is in alignment with the liquid hole.

4. The atomizer according to claim 3, wherein the rotary sealing element comprises a plurality of sealing ribs provided on a surface facing the atomizing assembly, and the sealing ribs surround the liquid holes.

5. The atomizer according to claim 3, wherein the atomizing assembly comprises at least one liquid conducting component and a heating element in contact with the at least one liquid conducting component, and the at least one liquid conducting component is configured for absorbing the tobacco liquid and conveying the tobacco liquid to the heating element for atomization.

6. The atomizer according to claim 1, wherein the liquid supply further comprises a tubular element in the liquid chamber and a mouthpiece, the tubular element is hollow and allows air to flow therethrough, the sealing piece is fixed at a first end of the tubular element, the rotary sealing element is rotatably coupled to the first end, and the mouthpiece is connected with an opposite second end of the tubular element.

7. The atomizer according to claim 6, wherein the connecting part defines an aerosol outlet, and the aerosol outlet communicates with the tubular element.

8. The atomizer according to claim 1, wherein the engaging part further comprises a connecting rotor fixedly connected with the rotary sealing element, the connecting rotor comprises an engaging part formed on a sidewall thereof; the connecting part defines an inserting opening and an arc-shaped groove, and the engaging part is engaged in the arc-shaped groove to form the snap fit connection.

9. The atomizer according to claim 1, wherein the first angle and the second angle are both 90 degrees.

10. An electronic cigarette, comprising:

an atomizer according to claim 1; and a power supply configured for supplying the atomizer power, a first end of the atomizing assembly being connected with the liquid supply, an opposite second end of the atomizing assembly being connected with the power supply.

* * * * *